United States Patent [19]

Ohta et al.

[11] Patent Number: 5,040,660

[45] Date of Patent: Aug. 20, 1991

[54] COP SORTING AND TRANSPORTING SYSTEM

[75] Inventors: Motomi Ohta, Kanazawa; Kaoru Taniguchi, Ishikawa, both of Japan

[73] Assignee: Kabushiki Kaisha Murao and Company, Kanazawa, Japan

[21] Appl. No.: 438,085

[22] Filed: Nov. 20, 1989

[30] Foreign Application Priority Data

Nov. 21, 1988 [JP] Japan ..... 63-294297

[51] Int. Cl.[5] ..... B31J 3/00

[52] U.S. Cl. ..... 198/352; 198/354; 209/927; 242/35.5 A; 57/281

[58] Field of Search ..... 209/3.1–3.3, 209/567, 569, 909, 927, 936, 583; 242/35.5 A; 57/281; 198/350, 351, 352, 354, 355

[56] References Cited

U.S. PATENT DOCUMENTS

| | | | |
|---|---|---|---|
| 3,973,006 | 8/1976 | Tooka | 57/281 X |
| 4,056,063 | 11/1977 | Ritter | 198/352 X |
| 4,552,072 | 11/1985 | Kardinal et al. | 198/352 X |
| 4,660,370 | 4/1987 | Matsui et al. | 242/35.5 A X |
| 4,854,453 | 8/1989 | Ueda et al. | 209/927 X |
| 4,940,127 | 7/1990 | Kikuchi et al. | 209/927 X |

FOREIGN PATENT DOCUMENTS

| | | | |
|---|---|---|---|
| 1064421 | 8/1959 | Fed. Rep. of Germany | 198/352 |
| 3518906 | 11/1986 | Fed. Rep. of Germany | 242/35.5 A |

*Primary Examiner*—Donald T. Hajec

*Attorney, Agent, or Firm*—Oblon, Spivak, McClelland, Maier & Neustadt

[57] ABSTRACT

A cop sorting and transporting system for a transporting step from spinning machines to winders in a spinning mill. A tab code representative of a type of a yarn of a cop is set arbitrarily to a tab device provided for each of cop magnazines which are provided for accommodating cops therein in order to selectively determine a destination of the cop magazine. The tab code of the tab device can be changed or reset to allow repetitive use of the tab device, which allows common use of the cop magazines to cope with production of many types of spun yarn by small quantities.

13 Claims, 7 Drawing Sheets

COP SORTING AND TRANSPORTING SYSTEM

FIELD OF THE INVENTION

This invention relates to a cop sorting and transporting system for sorting and transporting, when cops wound up on a spinning frame are to be transported to a next step in a spinning mill, the cops to predetermined destinations depending upon types of yarn of the cops.

BACKGROUND OF THE INVENTION

In a spinning mill, it is necessary to transport cops wound up by a spinning machine to a next step such as a winder. To this end, various automatic transporting systems have been proposed and put into practical use.

While such automatic transporting system may include such means as a belt conveyor or the like by means of which cops are transported at random, it may otherwise employ magazines for cops each having a suitable partition provided therein (hereinafter referred to as cop magazines). The latter means is very superior in that possible mechanical contact between cops is restricted to the minimum so that there is little possibility that yarn layers of the cops may be damaged (for example, Japanese Patent Publication No. 37-12733). Such cop magazine is preferably constituted such that partitions are formed in a vertical direction in such a manner as to push up cops in an order from the bottom portion to load the cops in position into the magazine, and also an automatic loading device for such cop magazine has been developed already (for example, Japanese Patent Laid-Open No. 49-26531).

Meanwhile, in a recent spinning mill, it is the actual state that production of many types in small quantities is inevitable. Accordingly, it is required for an automatic cop transporting system to provide exact indications of types of yarn of cops during transportation in order to prevent cops of different types of yarns from mixing with each other at a next step. To this end, it is a very popular practice that either cop magazines are differentiated in color for individual types of yarn of cops to be accommodated therein or different codes are set for different types of yarn and marked or written on cop magazines for facilitate use of particular cop magazines with a particular type of yarn.

With such conventional means, however, the cop magazines are used only with individually limited particular types of yarn. Consequently, such a cumbersome operation cannot be avoided that a cop magazine must be selected in conformity with a type of yarn to be spun on a spinning machine. In addition, there is another problem that, since a predetermined number of cop magazines are required for each type of yarns, a total number of required cop magazines is very great.

OBJECT OF THE INVENTION

The present invention has been made in view of such problems of the prior art as described above, and it is an object of the present invention to provide a novel cop sorting and transporting system wherein a code representative of a type of yarn (hereinafter referred to as tab code) can be changeably set to each cop magazine to allow all cop magazines to be used commonly for every type of yarn thereby to eliminate a cumbersome operation of selection of a cop magazine on the spinning machine side and the problem of a great total number of required cop magazines.

SUMMARY OF THE INVENTION

A cop sorting and transporting system according to the present invention which attains the object described above is constituted, as a subject matter, such that it comprises a cop transporting conveyor, a tab setter, and a tab reader, the cop transporting conveyor transporting cop magazines in which cops are accommodated, the tab setter being disposed at a starting point of the cop transporting conveyor, a tab code corresponding to a type of yarn being set to a tab device of each of the cop magazines, the tab reader reading a tab code set by the tab setter and selectively determining a destination of the cop magazine.

It is to be noted that the cop transporting conveyor can include stock lines for cop magazines sorted based on types of yarn, or branch conveyors to a plurality of winders, or else a working device line which should be passed or not passed depending upon types of yarn while the working device line can include standby lines for cop magazines sorted based on types of yarns.

Further, a tab clearer may be additionally provided for clearing a previously set tab code in prior to setting of another tab code by the tab setter.

With the cop sorting and transporting system having the construction described above, when a cop magazine in which cops are accommodated is sent out to the cop transporting conveyor, a tab code corresponding to a type of yarn can be set to a tab device provided on the cop magazine by means of the tab setter. Accordingly, if the tab reader for reading such tab code is disposed at a predetermined position of the cop transporting conveyor, then the type of yarn of the cops accommodated in the cop magazine can thereafter be judged in accordance with an output of the tab reader, and consequently, a destination of the cop magazine can be selectively determined based on the type of yarn.

It is to be noted that such destination of transportation may be stock lines for cop magazines sorted for individual types of yarn or branch lines to a plurality of winders. In the former case, cop magazines for a fixed type of yarn can be stored on each stock line, and accordingly, the possibility is eliminated that different types of yarn may be mixed for transportation to a next step. Meanwhile, in the latter case, such a situation can be prevented effectively that cops for different types of yarn are supplied in a mixed condition to the same winder.

Further, where a working device line which should be passed or not passed depending upon a type of yarn is included as part of the cop transporting system, whether or not working is required can be automatically judged depending upon a type of yarn to sort cop magazines. Further, where standby lines are provided in the working device line, cop magazines which require the same working conditions can be collected in a sorted condition on the standby lines. Accordingly, the working device line can appropriately cope with differences of the working conditions depending upon types of yarn.

Further, if a tab clearer is additionally provided, then a previously set tab code can be cleared by the tab clearer in prior to setting of another tab code by the tab setter, and consequently, an error in setting which may be caused by some trouble of the tab setter or the like can be detected and the reliability of the entire system can be improved.

DETAILED DESCRIPTION OF THE INVENTION

In the following, different embodiments of the present invention will be described with reference to the drawings.

Figure 1:
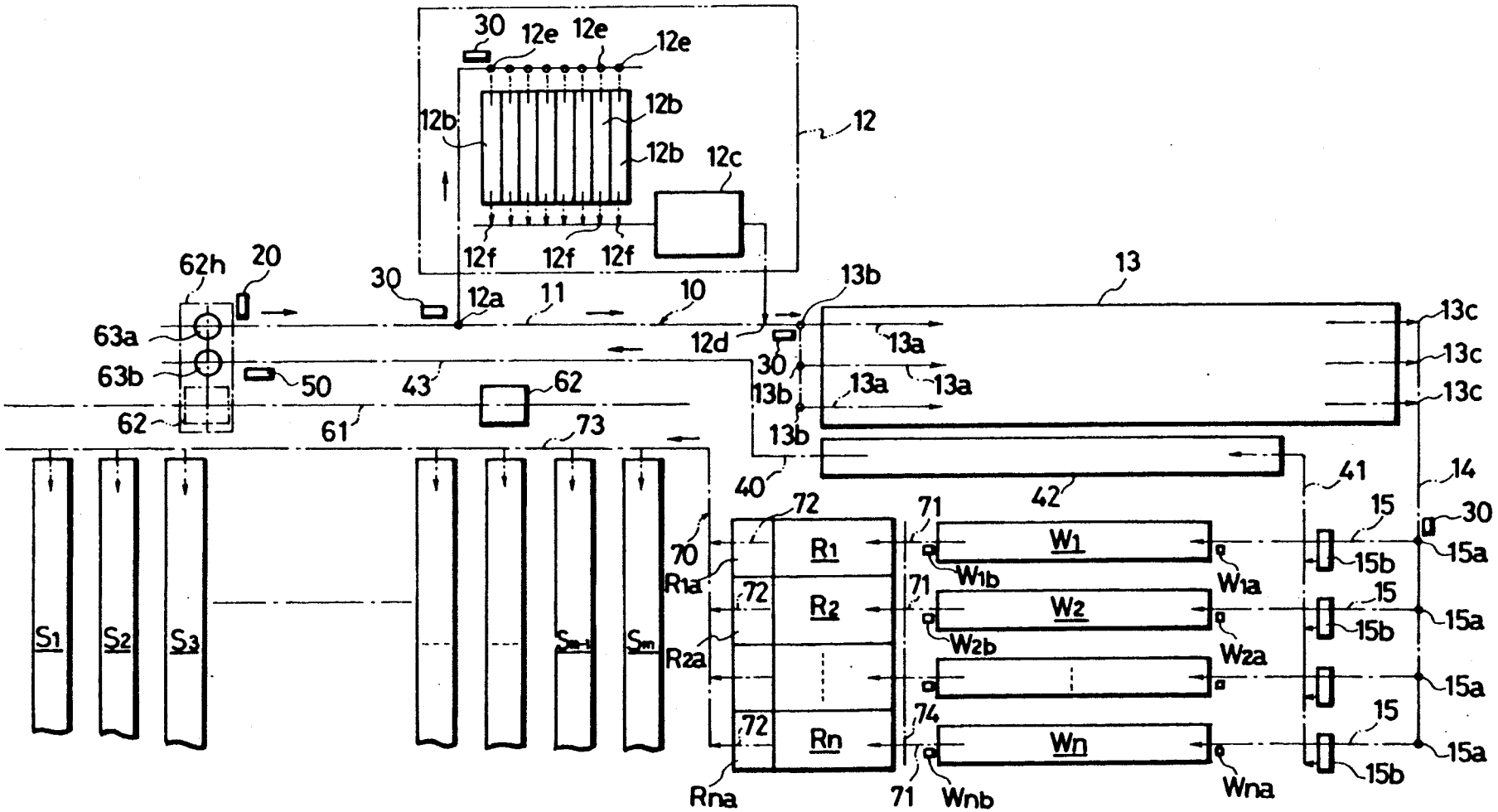
FIG. 1 is a diagrammatic representation of an entire cop sorting and transporting system showing an embodiment of the present invention.

Referring to FIG. 1, a cop sorting and transporting system includes, as principal components, a cop transporting conveyor system 10 interconnecting spinning machines Si (i=1, 2, . . . , m) and winders Wj (j=1, 2, . . . , n), a tab setter 20 disposed at a starting point of the cop transporting conveyor system 10, and a plurality of tab readers 30 disposed at predetermined locations of the cop transporting conveyor system 10.

Figure 2:
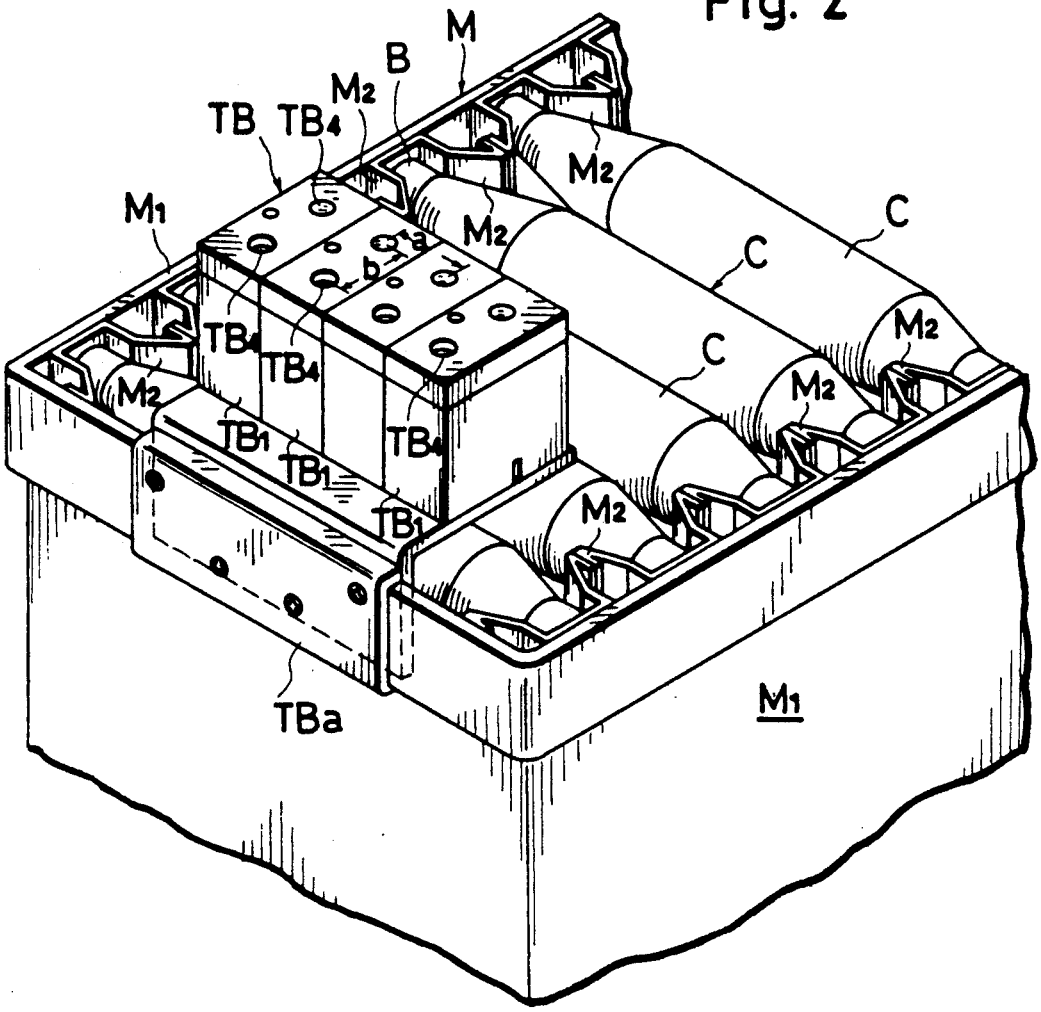
FIG. 2 is a perspective view showing part of a cop magazine.

Referring to FIG. 2, cops C adapted to be transported by the cop transporting conveyor system 10 are accommodated by a predetermined number in a cop magazine M for exclusive use. The cop magazine M is a vessel of the box type wherein pairs of opposing mountain-shaped partitions M2 are formed on inner faces of a pair of opposite side walls M1 and extend in vertical directions. Cops C are thus accommodated in several stages in the cop magazine M with the opposite end portions of bobbins thereof fitted between and restricted by adjacent ones of the partitions M2. It is to be noted that the cop magazine M has a catching mechanism not shown on the bottom thereof, and cops C are pushed upwardly and accommodated into the cop magazine M from below in such a manner as to push up the catching mechanism.

A tab device TB is provided projectingly at an upper edge of a side of the cop magazine M by way of a mounting bracket TBa.

Figure 3:
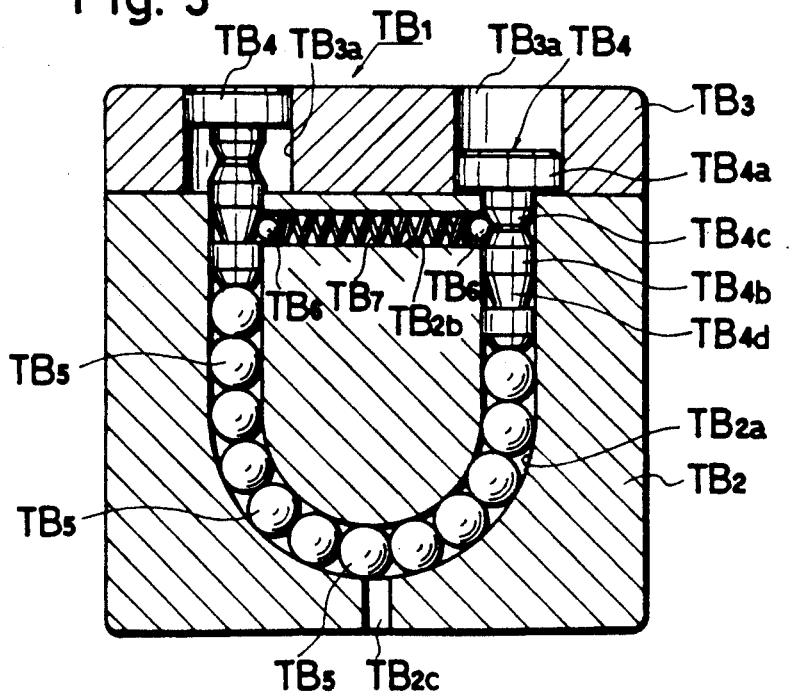
FIG. 3 is a sectional view of a tab device.

The tab device TB shown includes four tab units TB1 provided in a juxtaposed relationship to each other, and each of the tab units TB1 includes a unit body TB2 and an upper lid TB3 combined with the unit body TB2 and has a pair of code pins TB4 incorporated therein. In particular, referring also to FIG. 3, the unit body TB2 has a U-shaped guide hole TB2*a* formed therein while the upper lid TB3 has a pair of perforations TB3*a* of a greater diameter formed therein contiguously to the opposite ends of the guide hole TB2*a* of the unit body TB2, and the code pins TB4 are fitted for up and down shifting movement in the perforations TB3*a* of the upper lid TB3.

Each of the code pins TB4 has a leg portion TB4*b* depending from a lower face of a head portion TB4*a* thereof which has a substantially the same diameter with the perforations TB3*a*. The leg portion TB4*b* of each of the code pins TB4 can smoothly move into and out of the guide hole TB2*a*, and a large number of steel balls TB5 are inserted in the guide hole TB2*a* so that movement of one of the code pins TB4 may be transmitted to the other code pin TB4 by way of the steel balls TB5. The leg portion TB4*b* of each of the code pins TB4 has a shallow, annular recess TB4*c* of a V-shaped section and another annular recess TB4*d* of an inverted triangular section formed in two stages thereon. Meanwhile, a small hole TB2*b* is formed horizontally in the unit body TB2 and communicates the opposite upper end portions of the guide hole TB2*a* with each other, and a smaller steel ball TB6 is fitted in each of the opposite end openings of the small hole TB2*b* such that it may engage with the annular recess TB4*c* or TB4*d* of the corresponding code pin TB4 to define a lower or an upper shift position of the code pin TB4 thereby to define a stroke of vertical movement of the code pin TB4. A compression coil spring TB7 is fitted in the small hole TB2*b* and normally urges, at the opposite ends thereof, the steel balls TB6 to project from the small hole TB2*b* toward the code pins TB4.

Thus, when either one of the code pins TB4 is moved downwardly, the other code pin TB4 is moved upwardly like a seesaw, and at the upper shift position of a code pin TB4, the top face of the head portion TB4*a* of the code pin TB4 lies substantially in flush with the top face of the upper lid TB3, but at the lower shift position, a sufficiently deep recess is formed above the head portion TB4*a* of the code pin TB4. It is to be noted that a drain removing means in the form of a small perforation TB2*c* is formed in a lower wall of the unit body TB2 such that it communicates with a bottom portion of the guide hole TB2*a*. The code pins TB4 of the tab units TB1 of the tab device TB are arranged in four columns and two rows in predetermined pitches a and b, respectively, as shown in FIG. 2.

Referring back to FIG. 1, a cop boxing device 62 is disposed on the out end side of the spinning frames Si and adapted to move back and forth by itself on a guide rail 61. The cop boxing device 62 is constituted such that it can stop on the out end side of a predetermined spinning frame Si and accommodates cops C doffed from the spinning frame Si in an orderly fashion into a cop magazine M, and then transport the cop magazine M to a home position 62*h* provided on the guide rail 61.

The cop boxing device 62 can, at the home position 62*h* thereof, discharge the cop magazine M (hereinafter referred to as occupied magazine Ma), in which the cops M are accommodated, onto a turntable 63*a* which forms a starting end portion of the cop transporting conveyor system 10. Meanwhile, another turntable 63*b* is provided at a last end of an empty magazine conveyor system 40 which is disposed in such a manner as to reach the home position 62*h*, and the cop boxing device 62 can carry thereon an empty cop magazine (hereinafter referred to as empty magazine Mb) which has come to the turntable 63b, thereby to make preparations for an accommodating operation for cops C from another spinning frame Si.

The cop transporting conveyor system 10 is composed of a forward conveyor 11 which makes a first half, a working device line 12 which forms a bypass to the forward conveyor 11, a stock line 13, a communicating conveyor 14 which forms an exit passage from the stock line 13, and branch conveyors 15 which branch from the communicating conveyor 14 to the individual winders Wj.

The working device line 12 is a series of working lines which branch from the forward conveyor 11, at a branching point 12a and, passing a plurality of standby lines 12b and a working device 12c which performs a setting process of a cop C by steam, join the forward conveyor 11 at a joining point 12d. The working device 12c can make batch processing of a plurality of occupied magazines Ma while each of the standby lines 12b can store in a row thereon at least a number of occupied magazines Ma corresponding to one batch of the working device 12c. Branch points 12e and joining points 12f are formed on the upstream side and the downstream side, respectively, of the individual standby lines 12b.

On the other hand, the stock line 13 includes a plurality of rows of conveyors 13a each having a branch point 13b and a joining point 13c on the upstream side and the downstream side thereof, respectively. Each of the stock conveyors 13a can store thereon, for example, a number of occupied magazines Ma sufficient to absorb a difference in working capacity between the spinning frames Si which operate continuously day and night and the winders Wj which operate only in the daytime.

The branch conveyors 15 branch from the communicating conveyor 14 individually by way of branch points 15a. A cop feed device 15b is disposed intermediately of each of the branch conveyors 15 and operates to discharge cops C from an occupied magazine Ma transported thereto and forward only the cops C into a corresponding one of the winders Wj in response to a cop requesting signal from the winder Wj. In particular, on each of the branch conveyors 15, an occupied magazine Ma is transported to the cop feed device 15b, but only cops C are transported from the cop feed device 15b to the winder Wj. Yarn end pickup devices Wja (j=1, 2, . . . , n) for picking up an end of a yarn of a cop C are disposed at entrance ends of the winders Wj.

Empty magazines Mb discharged from the cop feed devices 15b are fed back to the home position 62h by way of the empty magazine conveyor system 40 which is composed of a connecting conveyor 41, an empty magazine stock line 42 and a return conveyor 43. The empty magazines Ma are thus used again by means of the cop boxing device 62.

Empty bobbins discharged from the winders Wj are returned to the spinning machines Si by way of a bobbin transport conveyor system 70 which is composed of a plurality of communicating conveyors 71, bobbin reservoirs Rj (j=1, 2, . . . , n) provided corresponding to the winders Wj, different communicating conveyors 72, and a return conveyor 73.

A remaining yarn detecting device Wjb (j=1, 2, . . . , n) for checking presence or absence of a remaining yarn on an empty bobbin is disposed at an exit end of each of the winders Wj. A transverse conveyor 74 extends transversely to the communicating conveyors 71 so that empty bobbins from any one of the winders Wj can be selectively thrown into and accumulated in an arbitrary one of the bobbin reservoirs Rj.

Each of the bobbin reservoirs Rj has a bobbin loader Rja (j=1, 2, . . . , n) provided therefor for transferring accumulated empty bobbins individually to the corresponding connecting conveyor 72. It is to be noted that the connecting conveyors 72 and the return conveyor 73 which interconnect the bobbin loaders Rja and the spinning machines Si preferably make a plurality of rows of bobbin transporting systems by which a predetermined empty bobbin can be selectively transported to a predetermined spinning machine Si in order that different bobbins may be allotted to the bobbin transporting systems depending upon types of yarn.

Cheeses discharged from the winders Wj are discharged to a next step by a transport conveyor line not shown.

The tab setter 20 is disposed in or adjacent the home position 62h of the cop boxing device 62 which makes the starting point of the cop transport conveyor system 10.

Figure 4:
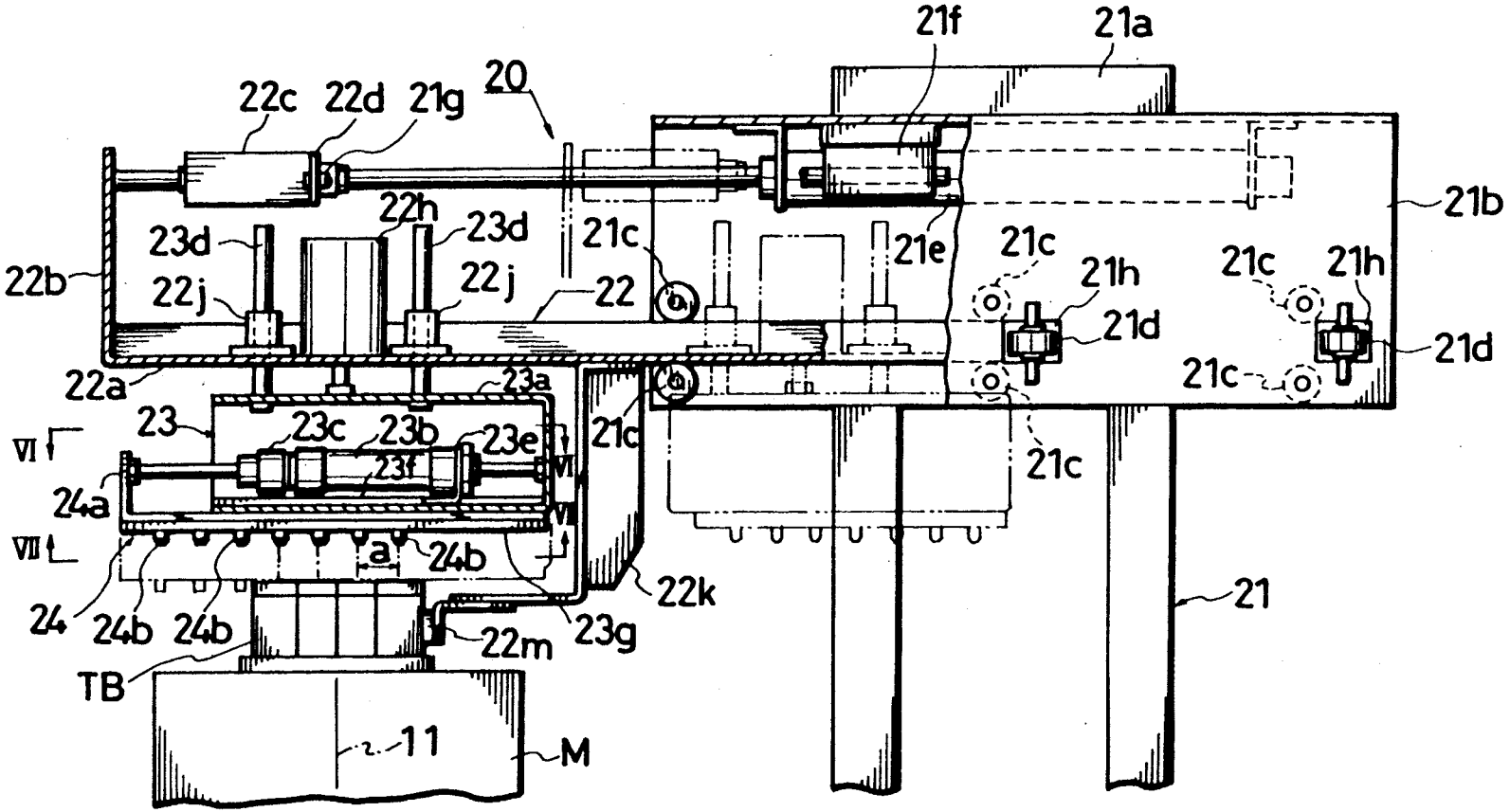
FIG. 4 is a side elevational view, partly in section, showing an entire tab setter.
Figure 5:
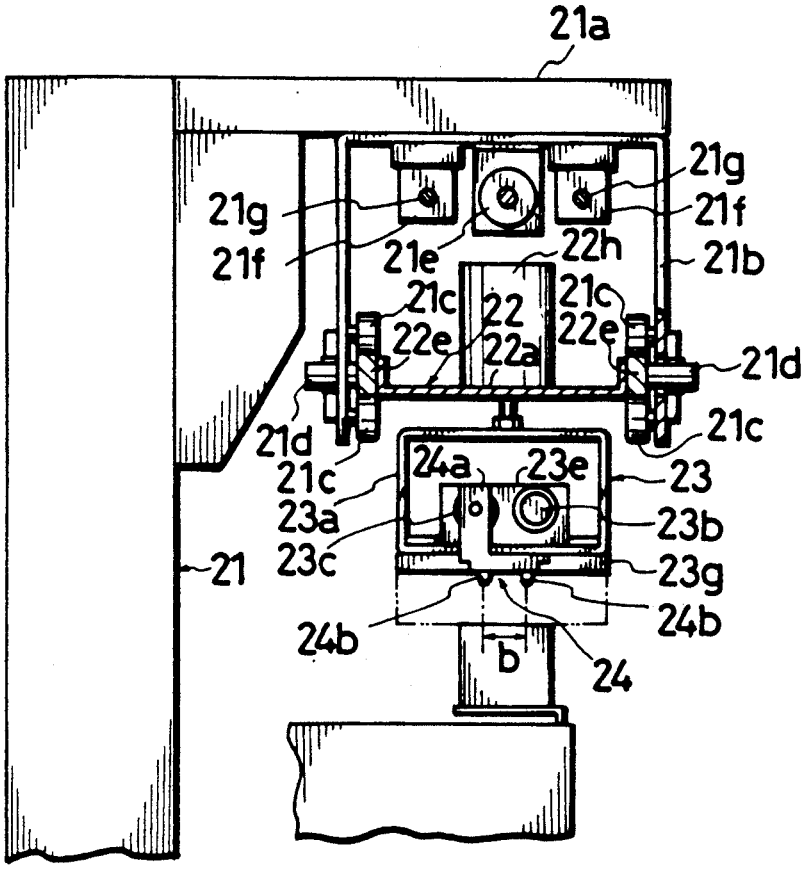
FIG. 5 is a sectional view showing part of the tab setter shown in FIG. 4.

Referring now to FIGS. 4 and 5, the tab setter 20 includes, in combination, a fixed frame 21, a forwardly and backwardly movable frame 22, a vertically movable frame 23, and a set plate 24 and is disposed alongside the forward conveyor 11.

A channel-shaped bracket 21b is mounted in a downward orientation on the fixed frame 21 by way of an arm 21a, and a plurality of guide rollers 21c and another plurality of guide rollers 21d are supported for rotation in vertical planes and in horizontal planes, respectively, at lower portions of the opposite sides of the bracket 21b. Each pair of upper and lower ones of the guide rollers 21c and a corresponding one of the guide rollers 21d make a set wherein the former guide rollers 21c are mounted on an inner face side of the bracket 21b while the latter roller 21d is mounted on an outer face side and partly projects toward the inner face side through an angular hole 21h formed in the fixed frame 21. Three sets of such guide rollers 21c and 21d are disposed in the forward and backward direction along each of the opposite sides of the bracket 21b. An air cylinder 21e is mounted at a top portion of the bracket 21b and a pair of guide blocks 21f are mounted on the opposite sides of the cylinder 21e at the top portion of the bracket 21b, and the air cylinder 21e and the guide blocks 21f extend in the forward and backward directions of the bracket 21b.

The forwardly and backwardly movable frame 22 is bent at a forward end portion of a base plate 22a of a C-shaped section thereof to form a connecting portion 22b which is connected to a rod of the air cylinder 21e by way of a cushion cylinder 22c and a connecting plate 22d. The connecting plate 22d is a plate member interposed between a base portion of the cushion cylinder 22c and an end of the rod of the air cylinder 21e, and a pair of guide rods 21g are secured at ends thereof to the opposite end portions of the connecting plate 22d and extend for sliding movement through the pair of guide blocks 21f (refer to FIG. 5).

The opposite sides of the base plate 22a are bent upwardly, and a pair of guide rails 22e are mounted on outer faces of the upwardly bent portions of the base plate 22a. The guide rails 22c are constituted such that they are restricted in vertical directions by the guide rollers 21c and in horizontal directions by the guide rollers 21d. An air cylinder 22h is provided downwardly on a front side of the base plate 22a while a pair of guide blocks 22*j* are disposed on the opposite sides of the air cylinder 22*h* on the front side of the base plate 22. A stopper 22*m* is disposed on a lower face of the base plate 22*a* by way of a stopper bracket 22*k*.

Figure 6:
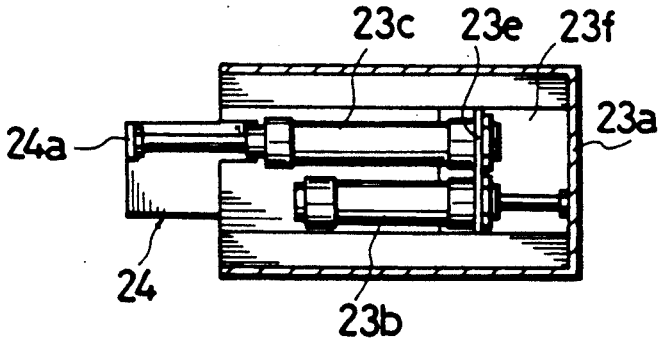
FIG. 6 is a sectional view taken along line VI—VI of FIG. 4.

Referring to FIG. 6, the vertically movable frame 23 includes a pair of air cylinders 23*b* and 23*c* incorporated in the inside of a cylinder bracket 23*a* in the form of an angular tube which is open on the front face side thereof. The cylinder bracket 23*a* is secured to an end of a rod of the air cylinder 22*h*, and a pair of guide rods 23*d* are provided uprightly on an upper face of the cylinder bracket 23*a* and extend for sliding movement through the guide blocks 22*j*.

The air cylinder 23*b* has a stroke equal to the pitch a of the arrangement of the code pins TB4 of the tab device TB on a cop magazine M in the leftward and rightward direction while the other air cylinder 23*c* has a stroke equal to twice the pitch a. The air cylinders 23*b* and 23*c* are mounted in a juxtaposed relationship on an L-shaped slide bracket 23*e* (FIG. 6). The slide bracket 23*e* is mounted for sliding movement in the forward and backward direction along a guide groove 23*f* formed on an inner face of a lower portion of the cylinder bracket 23*a*. A rod of the air cylinder 23*b* is securely connected to a rear face of the cylinder bracket 23*a* while a rod of the air cylinder 23*c* is connected to a bent portion 24*a* of the set plate 24 which stands uprightly in front of the cylinder bracket 23*a* (FIGS. 4 and 5).

Figure 7:
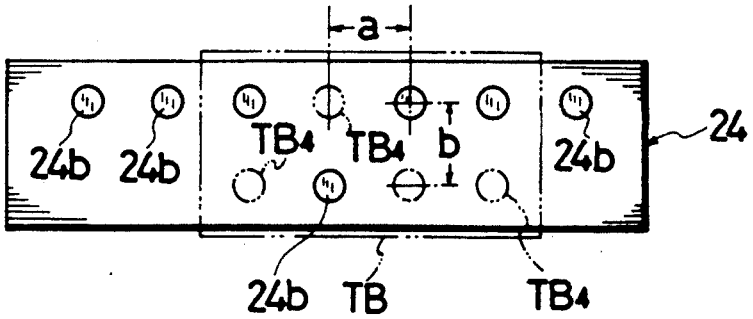
FIG. 7 is a view as viewed in the direction indicated by arrow marks VII—VII of FIG. 4.

The set plate 24 is a plate member having the bent portion 24*a* formed at a front end thereof, and the entire set plate 24 is carried for forward and backward movement on a support plate 23*g* securely mounted on a lower face of the cylinder bracket 23*a*. Up to seven tab setting pins 24*b* are provided on a lower face of the set plate 24 in equally spaced relationships to the pitches a and b of the arrangement of the code pins TB4 of the tab device TB (solid lines in FIG. 7). In particular, the tab set pins 24*b* are disposed in two front and rear rows such that the rear row includes 6 tab set pins 24*b* disposed except the central location while the front row includes only one tab set pin 24*b* disposed at a location corresponding to the central location of the rear row.

The tab setter 20 is disposed such that, when the air cylinder 21*e* is extended to advance the forwardly and backwardly movable frame 22, the vertically movable frame 23 comes to a position just above the tab device TB mounted on a cop magazine M on the forward conveyor 11 (solid line position in FIG. 4). Thereupon, the stopper 22*m* is abutted with a side face of the tab device TB to appropriately control the relative positions of the vertically movable frame 23 and the tab device TB. On the other hand, when the air cylinder 21*e* is contracted, the vertically movable frame 23 is retracted rearwardly (alternate long and two short dashes line position in FIG. 4), and consequently, it will not interfere with movement of a cop magazine M. Meanwhile, when the air cylinder 22*h* is extended or contracted, the set plate 24 is shifted from a lower position (alternate long and two short dashes line position in FIG. 5) in which it is contacted with an upper face of tab device TB and an upper position (solid line position in FIG. 4) in which it is spaced sufficiently from the tab device TB, or vice versa.

Further, combinations of the extended and contracted conditions of the air cylinders 23*b* and 23*c* provide four different positions in the forward and backward direction which are spaced from each other by a distance equal to the pitch a of the arrangement of the code pins TB4 of each tab device TB. Thus, if the set plate 24 is set to a selected one of the four positions 24 in the forward and backward direction and then the vertically movable frame 23 is moved downwardly, then the code pin TB4 in one of the two rows of a selected one of the tab units TB1 of a tab device TB is pushed downwardly by one of the tab setting pins 24*b* provided on the set plate 24 while the code pins TB4 in the other row of the other tab units TB1 are pushed downwardly by the tab set pins 24*b*, thereby setting a tab code to the tab device TB. Since up to four different codes can be set in this manner corresponding to the positions of the set plate 24, they can correspond to four different types of yarns of cops C.

Figure 8:
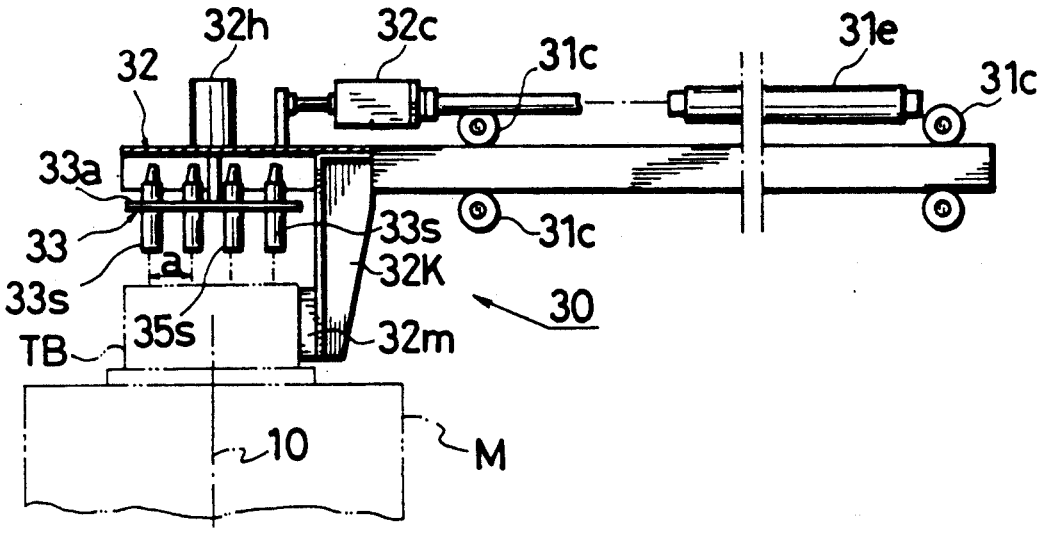
FIG. 8 is a side elevational view, partly in section, showing a tab reader.
Figure 9:
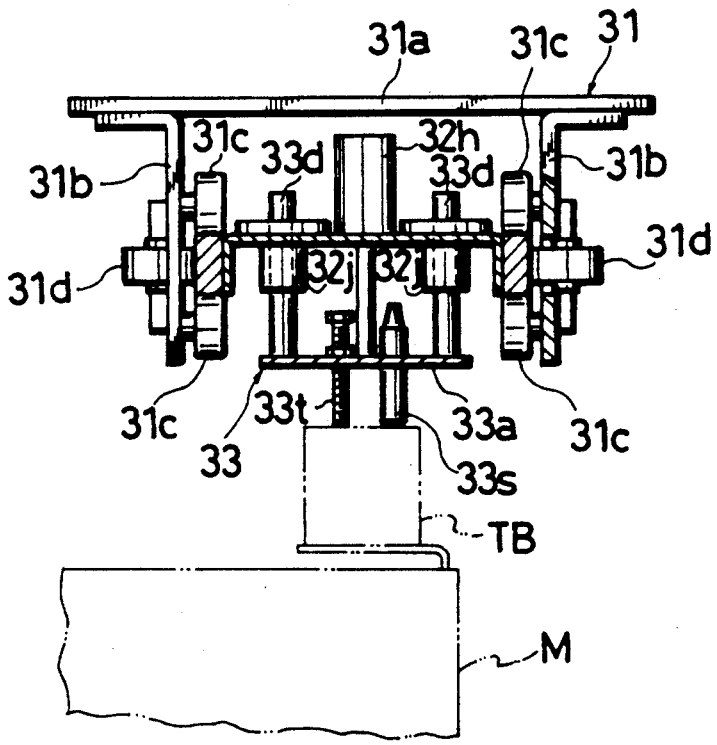
FIG. 9 is a sectional view of the tab reader shown in FIG. 8.

The tab readers 30 are disposed on the upstream sides of the individual branch points 12*a*, 12*e*, 13*b* and 15*a* intermediately of the cop transport conveyor system 10 shown in FIG. 1. Each of the tab readers 30 has a substantially same construction with the tab setter 20 as seen in FIGS. 8 and 9. In particular, each of the tab readers 30 includes a plurality of guide rollers 31*c* and 31*d* disposed by way of a pair of brackets 31*b* on a lower face of an arm plate 31*a* of a fixed frame 31 only part of which is shown in FIG. 9, and a forwardly and backwardly movable frame 32 which is moved forwardly or backwardly by way of a cushion cylinder 32*c* when an air cylinder 31*e* is driven. A vertically movable frame 33 having a sensor plate 33*a* is provided on and depends from a front portion of the forwardly and backwardly movable frame 32 by way of an air cylinder 32*h*, and a stopper bracket 32*k* with a stopper 32*m* is provided rearwardly of the vertically movable frame 33 and depends from the front portion of the forwardly and backwardly movable frame 32. A pair of guide rods 33*d* are provided uprightly on an upper face of the sensor plate 33*a* and extend for sliding movement through a pair of guide blocks 32*j*.

Four proximity sensors or switches 33*s* are disposed downwardly in a row on the sensor plate 33*a* in an equal pitch to the pitch a of the arrangement of the code pins TB4 of a tab device TB, and an adjusting bolt 33*t* is provided uprightly on the sensor plate 33*a*.

If the air cylinder 31*e* is extended to advance the forwardly and backwardly movable frame 32, the vertically movable frame 33 can be positioned to a position just above the tab device TB of a cop magazine M on the cop transporting conveyor system 10. Accordingly, if the vertically movable frame 33 is subsequently moved downwardly by means of the air cylinder *32h* as shown in FIG. 9. then the adjusting bolt 33*t* is contacted with an upper face of the tab device TB to stop sensing faces at the lower ends of the proximity switches 33*s* at positions close to but spaced by a predetermined distance from the code pins TB4 of the tab device TB. The proximity sensors 33*s* thus read whether the code pins TB4 in one row of all of the tab units TB1 of the tab device TB are individually positioned at the upper positions or the lower positions, thereby to read a tab code which has been set to the tab device TB by the tab setter 20.

A tab clearer 50 is diposed at a location near the home position 62*h* intermediately of the return conveyor 43 of the empty magazine conveyor system 40 shown in FIG. 1.

Figure 10:
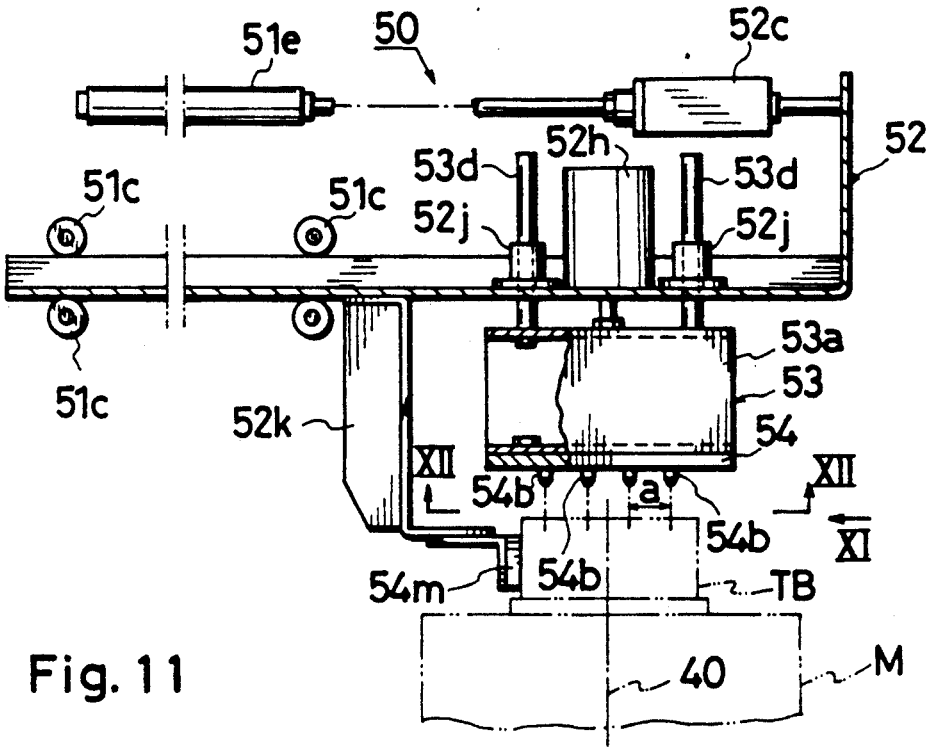
FIG. 10 is a side elevational view, partly in section, showing a tab clearer.
Figure 11:
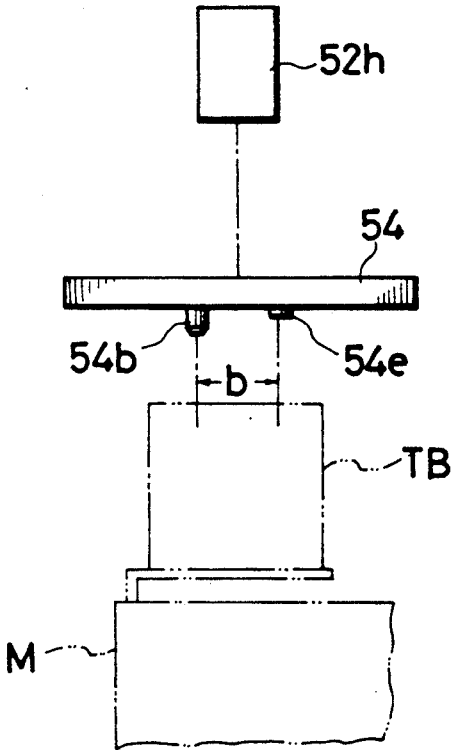
FIG. 11 is a view as viewed in the direction indicated by an arrow mark XI in FIG. 10.

Also the tab clearer 50 has a substantially same construction with the tab setter 20 or tab readers 30 (refer to FIGS. 10 and 11) and includes, as principal components, a forwardly and backwardly movable frame 52 which is driven to move forwardly or rearwardly by an air cylinder 51e by way of a a cushion cylinder 52c under the guidance of a plurality of guide roller 51c, and a vertically movable frame 53 which is driven to move upwardly or downwardly by an air cylinder 52h. The vertically movable frame 53 is composed of a frame member 53a in the form of an angular tube, and a pair of guide rods 53d are provided uprightly on an upper face of the vertically movable frame 53 and extend for sliding movement through a pair of guide blocks 52j. Meanwhile, a stopper bracket 52k with a stopper 52m is provided on and the depends from the forwardly and backwardly movable frame 52 rearwardly of the vertically movable frame 53.

Figure 12:
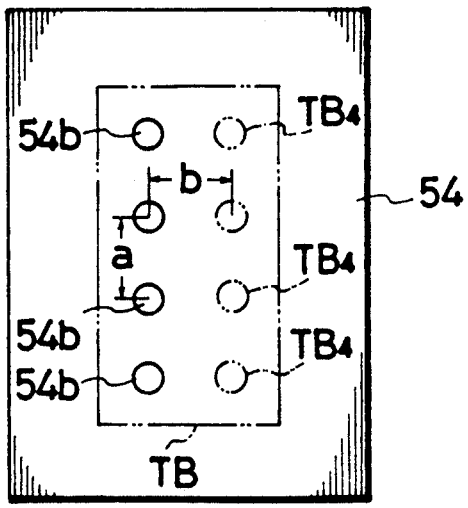
FIG. 12 is a view as viewed in the direction indicated by arrow marks XII—XII in FIG. 10.

A set plate 54 is securely mounted on a lower face of the vertically movable frame 53 as shown in FIG. 12, and four tab setting pins 54b and four tab resetting pins 54e are disposed each in a row on a lower face of the set plate 54 in equal pitches to the pitches of the arrangement of the code pins TB4 on a tab device TB. In FIG. 12, however, the code pins TB4 are shown corresponding to the positions of the tab resetting pins 54e.

If the forwardly and backwardly movable frame 52 is advanced and then the vertically movable frame 53 is moved down, then the tab setting pins 54b move down all of the code pins TB4 in one of the rows of the tab units TB1 forming the tab device TB. Consequently, a tab code which has been previously set to the tab device TB by the tab setter 20 can be cleared by the tab clearer 50. Thereupon, the tab resetting pins 54e simultaneously hold the head portions TB4a of upwardly moving ones of the code pins TB4 in the other row lightly from above to prevent the upwardly moving code pins TB4 from coming off upwardly from the tab device TB.

The cop sorting and transporting system having such a construction as described above operates in the following manner.

Referring to FIG. 1, when an arbitrary one of the spinning frames Si comes to a fully spun condition, it delivers a doffing signal to the cop boxing device 62 which is in a standby condition carrying an empty magazine Mb thereon. In response to the doffing signal, the cop boxing device 62 travels to the out end position of the spinning machine Si and receives cops C discharged from the spinning machine Si into the empty magazine Mb.

Subsequently, the cop boxing device 62 transports the thus occupied magazine Ma to the home position 62h and discharges it onto the turntable 63a. Consequently, the occupied magazine Ma can be thereafter transported toward the winders Wj by way of the cop transporting conveyor system 10. It is to be noted that the cop boxing device 62 receives an empty magazine Mb transported to the turntable 63b and thereafter remains in a standby condition.

Before the occupied magazine Ma on the turntable 63a is forwarded to the cop transporting conveyor system 10, a tab code corresponding to a type of yarn of the cops C accommodated in the occupied magazine Ma is set to the tab device TB by the tab setter 20. In particular, a yarn type signal from the spinning machine Si is transmitted to the tab setter 20 by way of the cop boxing device 62, and the tab setter 20 sets a predetermined tab code to the tab device TB on the occupied magazine Ma in accordance with the yarn type signal received. The occupied magazine Ma is then forwarded onto the forward conveyor 11.

The occupied magazine Ma transported on the forward conveyor 11 first comes to the tab reader 30 on the upstream side of the branch point 12a, and the tab code set thereon is read by the tab reader 30. In case the cops C are for the type of yarn which should pass the working device line 12, the tab reader 30 operates to direct the occupied manazine Ma in a branching manner to the working device line 12, but in other cases, the tab reader 30 directs the occupied magazine Ma straightforwardly to the stock line 13. In other words, the tab reader 30 can judge, in accordance with a tab code read thereby, whether the occupied magazine Ma should pass or not pass the working device line 12 depending upon a type of yarn and selectively determine a destination of the occupied magazine Ma The tab code of the occupied magazine Ma transported in a branching manner to the working device line 12 is then read by the tab reader 30 on the upstream side of the branch points 12e so that the occupied magazine Ma is selectively transported to one of the standby lines 12b depending upon the type of yarn, In particular, each of the standby lines 12b is provided to store thereon a plurality of occupied mangazines Ma to be batch processed by the working device 12c, and the tab reader 30 then judges a type of yarn from the tab code and selectively transports the occupied magazine Ma to a predetermined one of the standby lines 12b. The occupied magazine Ma transported onto the standby line 12b is subjected to predetermined working successively together with succeeding occupied magazines Ma by the working device 12c and then joins to the forward conveyor 11 at the joining point 12d.

The tab reader 30 on the upstream side of the branch points 13b reads the tab code of an occupied magazine Ma transported thereto after passing or without passing the working device line 12 in this manner and selectively transports the occupied magazine Ma to one of the stock conveyors 13a of the stock line 13 depending upon a type of yarn of the cops C in the occupied magazine Ma.

On the other hand, the tab reader 30 on the upstream side of the branch points 15a reads the tab code of an occupied magazine Ma discharged from one of the stock conveyors 13a in response to a requesting signal from the cop feed device 15b and selectively transports the occupied magazine Ma to one of the winders Wj depending upon a type of yarns of the cops C in the occupied magazine MA. However, when the cop feed device 15b outputs a driving signal for a particular one of the stock conveyors 13a to the stock line 13 in order that one of the winders Wj may receive a supply of cops C of a predetermined type of yarn, the tab reader 30 on the upstream side of the branch points 15a must only make a confirming operation that the occupied magazine Ma discharged from the stock line 13 is of the predetermined type of yarn.

An occupied magazine MA transported into one of the branch conveyors 15 then comes to the corresponding cop feed device 15b by which the cops C are discharged from the occupied magazine Ma so that the magazine now makes an empty magazine Mb. Then, the cops C are transported to the corresponding winder Wj while the empty magazines Mb are forwarded into the empty magazine stock line 42 by way of the connecting conveyor 41 of the empty magazine conveyor system 40 and then transported to the home position 62h by the return conveyor 43. Since the tab clearer 50 is disposed intermediately to the home position 62h, the previously set tab code of the empty magazine Mb is cleared in prior to re-use of the empty magazine Mb by the cop boxing device 62.

If each of the tab devices TB in the foregoing descripiton is constituted from an arbitrary number t of tab units TB1, then it can cope with t types of yarns. Furthur, if the system of tab codes set by the tab setter 20 and read by the tab readers 30 is a binary code system wherein each of the tab units TB1 corresponds to 1 bit, then each of the tab devices TB can cope with up to $2^t$ types of yarn. Other Embodiments Two occupied magazines Ma and two empty magazines Mb may be transferred at a time at the home position 62*h* between the cop boxing device 62 and the forward conveyor 11 and between the cop boxing device 62 and the return conveyor 43, respectively, as shown in FIGS. 13(A) to 13(D). In particular, the cop boxing device 62 boxes cops C discharged from an arbitrary one of the spinning machines Si into two occupied magazines Ma and transports them to the home position 62*h* (FIG. 13(A)). On the other hand, the turntables 63*a* and 63*b* are provided in a juxtaposed relationship on a stroke mechanism 63*c*. Thus, if the cop boxing device 62 at first discharges the two occupied magazines Ma onto the turntables 63*a* and 63*b* and then moves the stroke mechanism 63*c* to the last end position of the forward conveyor 11 whereafter the turntables 63*a* and 63*b* are each turned by 90 degrees (FIG. 13(B)), then the two occupied magazines Ma can be forwarded to the forward conveyor 11.

Figure 13:
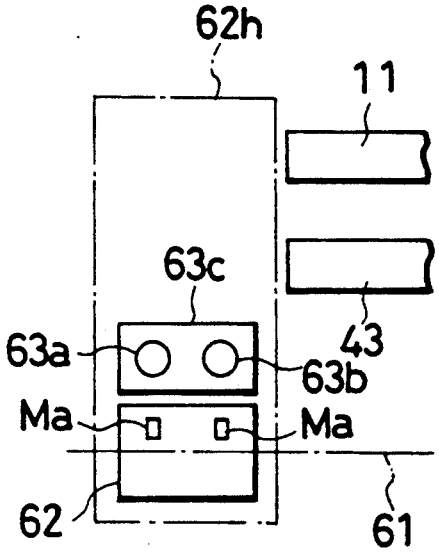
FIGS. 13(A) to 13(D) are diagrammatic representations illustrating operation of a cop sorting and transporting system according to another embodiment of the present invention.
Figure 13:
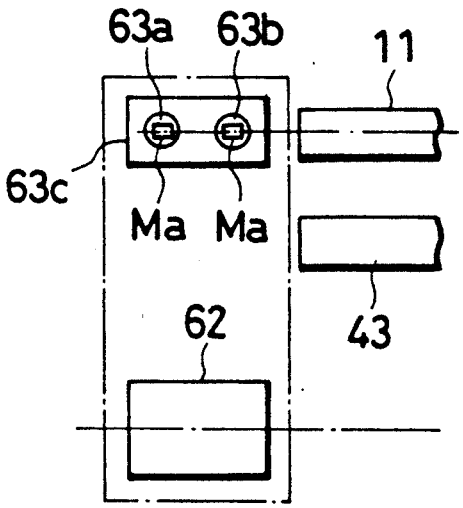
Figure 13:
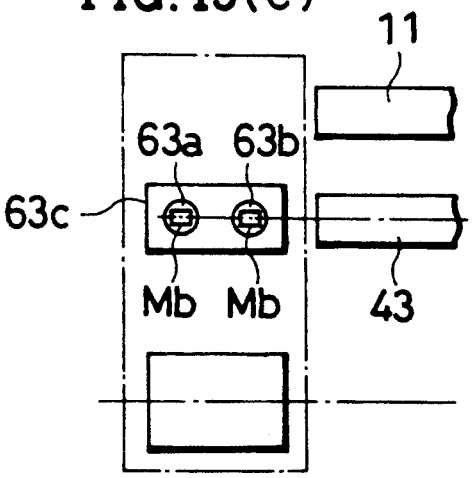
Figure 13:
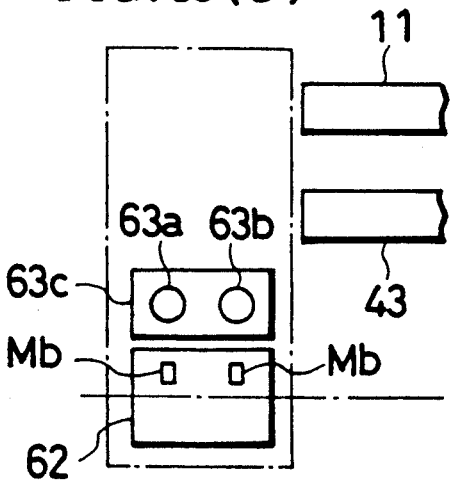

Subsequently, the stroke mechanism 63*c* is moved to the last end position of the return conveyor 43 and transfers two empty magazines Mb on the return conveyor 43 to the turntables 63*a* and 63*b* (FIG. 13(C)). Then, if the stroke mechanism 63*c* is moved to a position proximate the cop boxing device 62 and then the urntables 63*a* and 63*b* are turned by 90 degrees, then the two empty magazines Mb can be transfered to the cop boxing device 62 (FIG. 13(D)). Where the spinning machines Si are of the double side type, cops C wound up on the right side and the left side of each of the spinning machines Si are boxed into different empty magazines Mb, and consequently, such magazines can be forwarded as occupied magazines Ma to the forward conveyor 11. It is to be noted that, in this instance, the occupied magazines Ma forwarded to the forward conveyor 11 may be independently advanced to the transporting route described above.

The working device line 12 included in the cop transporting conveyor system 10 should be provided only where necessary, and it can be omitted in a common cotton spinning mill. The required capacities and the numbers of parallel lines of the standby lines 12*b* in the working device line 12, the stock conveyors 13*a* in the stock line 13 and the empty magazine stock lines 42 in the empty magazine conveyor system 40 should be determined suitably in accordance with such conditions as the numbers, processing faculties, working times and so forth of the spinning machines Si, winders Wj and working devices 12*c*. However, since types of yarn to be worked on the spinning machines Si are usually changed over while performing continuous operation of the entire mill, when a type of yarn is to be changed over, the cop transporting conveyor system 10 must transport cops of yarn before and after such changing over in a mixed condition, and this may be an important factor when the capacities of the individual members and so forth are to be determined.

The tab clearer 50 is provided to clear a tab code set to each of the tab devices TB to improve the reliability of a new tab code to be set subsequently or to detect a trouble of the tab setter 20. Accordingly, where the tab setter 20 is constituted such that it can made an operation of clearing a previously set tab code and an operation of setting a new tab code with certainty as in the preceding embodiment, naturally the tab clearer 50 may be omitted. Further, where the tab clearer 50 is employed, since it must only be able to clear a previously set tab code in prior to setting of a tab code by the tab setter 20, it can be located at an arbitrary position at which it can make access to an empty magazine Mb.

It is to be noted that each of the tab devices TB described hereinabove in connection with the preceding embodiment mechanically sets a tab code by upward and downward shifting movement of the code pins TB4, there is an advantageous feature that it can operate without an electric power source and besides a set tab code can be checked visually. Naturally, however, each of the tab devices TB may be replaced by a combination of a common magnetic or electronic memory device and a suitable display device.

What is claimed is:

1. A cop sorting and transporting system for sorting cops wound up on spinning machines in accordance with types of yarn and transporting the cops to a next step, comprising:

cop magazines for accommodating a predetermined number of wound up cops therein, each of said cop magazines having a tab device for indicating a tab code thereon;

a cop transporting conveyor for transporting said cop magazines;

a tab setter for setting a tab code to said tab device of each of said cop magazines for each of the types of yarn; and a tab reader for reading a tab code set by said tab setter;

wherein said tab device includes one or more tab units each of which is composed of a unit body having a U-shaped guide hole formed therein and a pair of code pins fitted in the opposite openings of said guide hole of said unit body, said guide hole being filled with a plurality of steel balls such that, when one of said code pins is moved down, the other code pin may be moved up by way of said steel balls.

2. A cop sorting and transporting system according to claim 1, wherein said cop transporting conveyor includes a stock conveyor connected to a stock line for storing thereon said cop magazines sorted for the individual types of yarn.

3. A cop sorting and transporting system according to claim 1 and 2, wherein said cop transporting conveyor includes a plurality of branch conveyors for introducing said cop magazines sorted for the individual types of yarn individually to a plurality of winders.

4. A cop sorting and transporting system according to claim 1, wherein a working device line is connected to said cop transporting conveyor, and whether or not a cop should pass said working device line depends upon a type of yarn of the cop.

5. A cop sorting and transporting system according to claim 4, wherein said working device line includes standby lines for storing therein said cop magazines sorted based on types of yarn.

6. A cop sorting and transporting system according to claim 1, wherein a tab clearer is provided for clearing a previously set tab code in prior to setting of a tab code by said tab setter.

7. A cop sorting and transporting system according to claim 1, wherein said tab device includes a plurality of tab units disposed in a juxtaposed relationship to each other.

8. A cop sorting and transporting system according to claim 1, wherein said tab setter is disposed adjacent said cop transporting conveyor, and a vertically movable frame is disposed on said tab setter for forward and backward movement and also for upward and downward movement relative to the cop magazine while a set plate for setting a plurality of different tab codes is provided on said vertically movable frame.

9. A cop sorting and transporting system according to claim 1, wherein said tab reader is constructed for forward and backward movement and also for upward and downward movement relative to the cop magazine and includes a proximity switch for detecting a lifted position or a lowered position of a code pin of said tab device.

10. A cop sorting and transporting system according to claim 6, wherein said tab clearer is constructed for forward and backward movement and also for upward and downward movement relative to the cop magazine, and a set plate is provided which has a fixed pin for setting a tab code to a fixed position.

11. A cop sorting and transporting system according to claim 8, wherein said set plate is mounted on said vertically movable frame by way of a plurality of cylinders such that said set plate may be moved horizontally forwardly or backwardly by different pitches depending upon a combination of elongations and constractions of said plurality of cylinders.

12. A cop sorting and transporting system according to claim 1, wherein a home position is connected to said cop transporting conveyor and includes a cop boxing device for accommodating cops doffed from a spinning machine into a cop magazine, and a cop magazine in which cops are accommodated and an empty magazine are exchanged at said home position.

13. A cop sorting and transporting system according to claim 12, wherein two cop magazines in which said cops are accommodated and two empty magazines can be exchanged at said home position.

* * * * *